US007805876B1

(12) United States Patent
Danielson et al.

(10) Patent No.: US 7,805,876 B1
(45) Date of Patent: Oct. 5, 2010

(54) LASER GUNSIGHT SYSTEM FOR A FIREARM HANDGRIP

(75) Inventors: Lewis A Danielson, Portland, OR (US); Jonathon Daniel Rievley, Sherwood, OR (US); Daniel Lee Hughes, Damascus, OR (US)

(73) Assignee: Crimson Trace Corporation, Wilsonville, OR (US)

( * ) Notice: Subject to any disclaimer, the term of this patent is extended or adjusted under 35 U.S.C. 154(b) by 319 days.

(21) Appl. No.: 12/152,260

(22) Filed: May 12, 2008

(51) Int. Cl.
*F41G 1/00* (2006.01)

(52) U.S. Cl. ..... 42/114; 42/117; 42/90; 362/114

(58) Field of Classification Search ..... 42/114, 42/117, 90; 362/110, 114
See application file for complete search history.

(56) References Cited

U.S. PATENT DOCUMENTS 5,194,007 A * 3/1993 Marshall et al. ..... 434/21
5,435,091 A 7/1995 Toole et al.
5,560,703 A * 10/1996 Capps, III ..... 362/110
7,260,910 B2 8/2007 Danielson

* cited by examiner

*Primary Examiner*—J. Woodrow Eldred
(74) *Attorney, Agent, or Firm*—Bennet K. Langlotz; Langlotz Patent & Trademark Works, Inc.

(57) ABSTRACT

The present invention overcomes the limitations of the prior art by providing a sighting device for a firearm having a handgrip with a front strap, a back strap, and a free end. The sighting device has a body including a sleeve defining a bore sized to closely encircle at least a portion of the handgrip. The sleeve has a front portion configured to wrap about at least a forward front strap portion of the firearm, and has a rear portion configured to wrap about at least a rear back strap portion of the firearm. A laser device is connected to the body. The body may be an integral element, and may have a switch on the front span. The body may have a removable lock device that engages an upper rear protrusion of the frame, and the device may attach to the firearm without any fasteners engaging the firearm.

21 Claims, 5 Drawing Sheets

LASER GUNSIGHT SYSTEM FOR A FIREARM HANDGRIP

FIELD OF THE INVENTION

This invention relates to a laser gunsight system designed to fit the handgrip of a firearm without requiring significant modification of the firearm, the laser gunsight being operable by the user while the firearm is gripped by the handgrip in the firing position.

BACKGROUND AND SUMMARY OF THE INVENTION

When using firearms, it is often advantageous for the user to be able to quickly and accurately point the firearm at the target. Many devices assisting in the aiming of a firearm are available, including the classic V-sight, peephole sight, 3-dot sight and similar iron-sight structures, as well as telescopic or optical sights. However, when light conditions are poor such as at night, or in darkened rooms of buildings, a sighting device that relies on ambient light is at a disadvantage. Under such conditions, the target may itself be difficult to acquire visually and to follow if it is moving, and gunsights that are lit only by external light sources are less effective due to the need to see them and align them with the already poorly-perceived target at the time of firing the firearm.

Under poor lighting conditions, self-illuminated gunsights such as tritium sights may be used, but again the effectiveness of such sights depends on the user's ability to align them accurately with a possibly poorly-seen or moving target. This is particularly significant to police and military users of firearms, who in the course of their duties may very likely be confronted with a moving, dangerous threat under poor lighting conditions. To accommodate such users, sights have been developed wherein a battery-powered laser is used, the laser having been adjusted to illuminate the point of aim of the firearm. When the laser is turned on by the user of the firearm, it shines light in the direction the bullet will travel when the firearm is fired. Thus, the firearm is aimed merely by directing the laser beam towards the target. The laser beam strikes the target and is reflected back to the user's eye, informing the user exactly where the firearm is aimed and thus what the point of impact of a bullet will be if the firearm is fired.

Various laser gunsight systems have been developed for use with firearms that are equipped with a handgrip, such as handguns, or long guns having a buttstock with a "pistol-grip". The handgrip of a handgun is grasped by the user's hand or hands when the firearm is being held in the firing position. With a long gun, i.e., a rifle or a shotgun, equipped with a handgrip or pistol-grip, typically the rear or "trigger" hand holds the handgrip while the front hand holds the forestock when the firearm is in the firing position.

Kaminski, U.S. Pat. Nos. 5,704,153 and 5,867,930, discloses a firearm battery and control module for a gunsight laser wherein the battery and control circuitry are contained within a housing that fits inside the handgrip of a firearm. The stock handgrip, that is, the handgrip that the firearm is normally provided with by the manufacturer, must be replaced with a specially adapted or custom handgrip containing components of the laser gunsight system to allow this system to be used.

Willoughby, U.S. Pat. No. 5,177,309, discloses a laser-aimed weapons system in which a small laser unit is attached to the bottom end of a handgun grip. The switch is incorporated in the laser unit and is largely inaccessible to operation when the firearm is in firing position.

Houde-Walter, U.S. Pat. No. 6,591,536, discloses a laser assembly that is mounted on the side of a handgun frame above the trigger, the switch being contained in the unit and typically operated by the user's trigger finger.

Teetzel, U.S. Pat. No. 5,481,819, discloses a laser sight that may be used on a handgun, the switch and circuitry for which is located inside modified custom handgrips that replace the stock handgrips supplied with the firearm.

Toole et al., U.S. Pat. No. 5,706,600 discloses a laser sight that may be used on a handgun wherein the laser is disposed forward of the trigger guard, a switch is disposed below the trigger guard and a power supply is disposed within the handgrip of the firearm.

Toole, et al., U.S. Pat. No. 5,435,091, discloses a laser sight disposed at the top of the handgrip rearward of the trigger wherein the power supply and circuitry is contained within a customized handgrip.

Danielson, U.S. Pat. No. 7,260,910 discloses a pistol handgrip mounted laser device that is designed for use on pistols without removable handgrips, such as plastic framed pistols. The disclosed device wraps about the sides and rear of the pistol, and has an actuation switch at the rear, where it is activated by pressure from the web of the user's hand. For some users, alternative switch locations may be preferred. The body of the device adds thickness at the upper rear of the grip, making it less suitable for users with other comfort and feel preferences, as it shifts the hand back slightly with respect to the trigger, and increases the effective circumference of the pistol grip. In addition, the disclosed grip is secured against removal by sharing a pin that extends laterally through the frame of the pistol, at rear of the grip toward the upper end. Many pistols lack this attachment point, and thus cannot use the disclosed device. Even for those pistols with such an attachment point, the minor pistol disassembly required for installation may cause some users to be reluctant to attempt installation, and may limit the market for the product.

However, there is a need for a laser sighting system that may be used with stock firearms, not requiring replacement of handgrips, attachment of special rails, removal and reinstallation of firearm pins, or other modifications. Furthermore, a system that can be readily operated by a user with the firearm in firing position, using only the hand gripping the firearm without requiring movement of the hand from the position normally used when aiming and firing the firearm, would be advantageous.

The present invention overcomes the limitations of the prior art by providing a sighting device for a firearm having a handgrip with a front strap, a back strap, and a free end. The sighting device has a body including a sleeve defining a bore sized to closely encircle at least a portion of the handgrip. The sleeve has a front portion configured to wrap about at least a forward front strap portion of the firearm, and has a rear portion configured to wrap about at least a rear back strap portion of the firearm. A laser device is connected to the body. The body may be an integral element, and may have a switch on the front span. The body may have a removable lock device that engages an upper rear protrusion of the frame, and the device may attach to the firearm without any fasteners engaging the firearm.

DETAILED DESCRIPTION OF A PREFERRED EMBODIMENT

Figure 1:
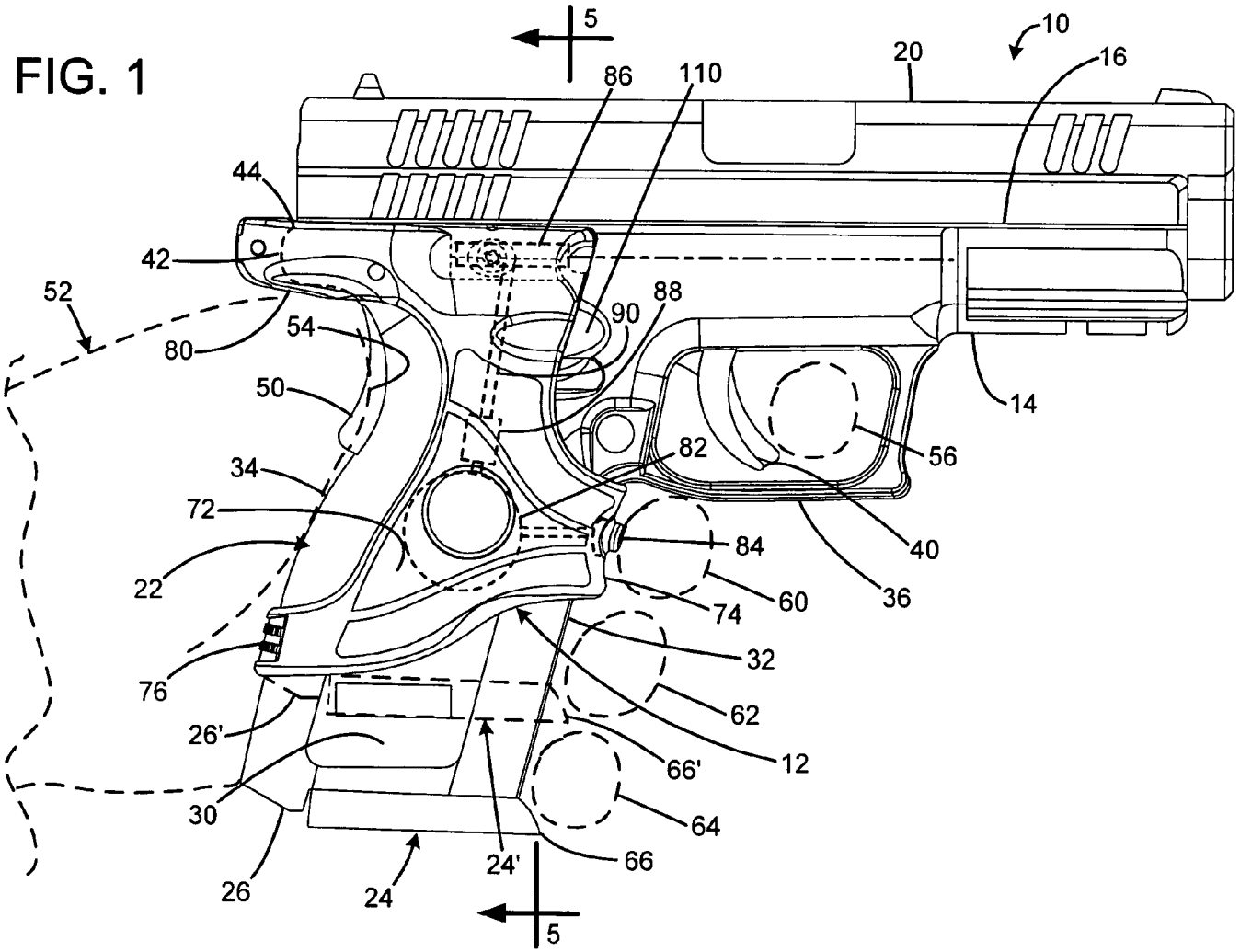
FIG. 1 is a right side view of a preferred embodiment of the invention as installed on a pistol.

FIG. 1 shows a firearm 10 with an attached laser aiming device 12. The pistol has a one-piece integrally molded plastic frame 14 that includes an upper edge 16 immediately below the lower edge of a slide 20 that reciprocates with respect to the pistol during chambering of cartridges and ejection of casings. Note that the device may be employed on any type of pistol or firearm in addition to those with integrally-molded frames.

The frame has a downwardly-extending handgrip 22 that angles slightly rearward and is a tubular body defining a well receiving a magazine 24. The handgrip has a lower free end 26. The grip has flat side portions 30, and a curved front strap 32 facing forward, and a curved back strap 34 facing to the rear. The grip generally has an oblong or "racetrack" cross section. At the upper end of the front strap, a trigger guard 36 projects forward, and protects the trigger 40. The back strap extends nearly to the upper edge 16 of the frame, curving rearward at its upper portion. A beavertail protrusion portion 42 of the frame protrudes rearward at the upper end of the back strap. The beavertail has an angled upper surface 44 that is below the plane of the upper edge 46, and faces upward at an angle toward the rear. At the upper portion of the back strap, a grip safety switch 50 protrudes slightly. The grip safety is spring biased to the "safe" position shown, so that the gun will not fire even when the trigger is pulled.

A compact version of the same pistol is shown in dashed lines, with the only difference being that the grip length is reduced, so that the lower end 26' is higher than the end 26 of the full-size pistol, and the magazine 24' does not extend as far as the full size magazine 24.

When a user grips the gun normally with his hand 52, the web of flesh 54 between palm and forefinger presses against the back strap and depresses the grip safety, which pivots to an "off" position where firing is enabled. Note that the device is also suitable for firearms without such a grip safety. The user's index (trigger) finger 56 is within the trigger guard and presses the trigger for firing. The middle finger 60 is positioned immediately below the trigger guard, just forward of the front strap. The ring finger 62 is positioned just below the middle finger, resting on the front strap. The little finger 64 is below the ring finger, just above a protrusion 66 on the front edge of a plate at the lower end of the magazine. In the compact pistol embodiment, the ring finger is just above the magazine plate protrusion 66', and the little finger generally curls underneath the bottom of the magazine.

Figure 2:
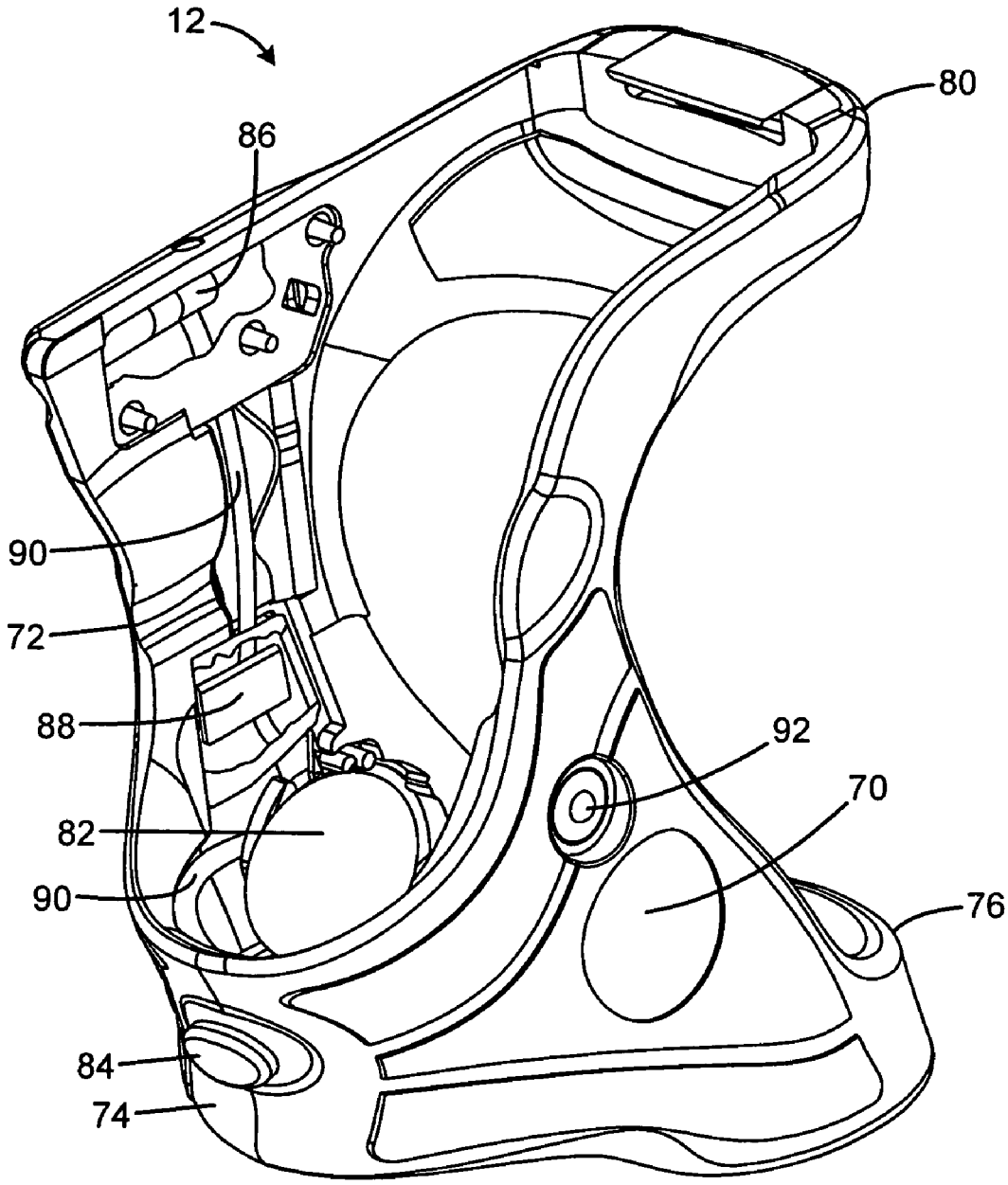
FIG. 2 is a perspective view of the embodiment of FIG. 1, showing the interior of the device.

FIG. 2 shows the laser aiming device 12 separate from the pistol. The device has a left panel 70, an opposed right panel 72, a curved front span portion 74 smoothly joining the front edges of the side panels, and a curved lower rear span portion 76 smoothly joining the lower edges of the side panels. An upper rear span portion 80 smoothly joins the upper rear corners of the side panels. The side panels are somewhat triangularly shaped.

The panels and spans are smoothly transitioned to each other, and the edges of the panels and spans are complex curves. The amorphous or organic shape is partly dictated by the goal that the device have minimal perceived effect on the size of the grip in a user's hands. This means that the device has the minimum volume to enclose needed components, and dimensions needed for strength and durability. The illustrated curved shapes are provided for an aesthetic appearance and for comfort. The minimal, "skeletonized" form also minimizes weight, and further facilitates installation and removal of the device from the firearm by reducing friction and potential interference.

The body forms a "sleeve" in the sense that it has one or more topologically continuous loops or bands, with no interruptions as it encompasses or encircles the space in which the handgrip will closely be received. A "sleeve" is formed by the ring formed by side panels and front and lower rear spans even if the upper rear span were not connected. A sleeve may said to be formed by the side panels, front span and upper rear span even if the lower rear span were not present or connected.

The device has a body molded as a single piece from thermoplastic such as nylon or ABS, with nylon material used for pistol frames, thereby providing compatibility. While no plastic is entirely rigid, the material is essentially rigid in the sense that it does not elongate or compress in any significant way that affects dimensions or functionality during installation or use. The only flexure of significance is in bending of flat panel portions, to allow certain portions to bend out of the way for installation over protrusions, and to snap into place when properly seated. The body is essentially inelastic, and this provides a material comparable in characteristics and appearance to materials used for molding plastic pistol frames.

The body contains a number of electronic components. A flat, disc-shaped battery 82 is contained in a recess in the inner face of each side panel. A momentary on-off switch 84 having a flexible rubber actuator is mounted at the center of the front span. A laser diode 86 is mounted within the upper front portion at as high a location as possible (but below the level of the lower slide edge) to avoid interference by the user's grip hand with the laser beam, and intrusion of the portion of the body into the area where the hand must comfortably rest. Set screws in the body provide aiming adjustments of the laser with respect to the body. Control circuitry 88 is mounted in an interior recess, and the components are interconnected by thin flexible circuitry or wires 90. The circuitry also connects to a master power switch 92 that is recessed in the outside of the left side panel, so that the entire device may be disabled when not in use to prevent accidental actuation and preserve battery life.

Figure 3:
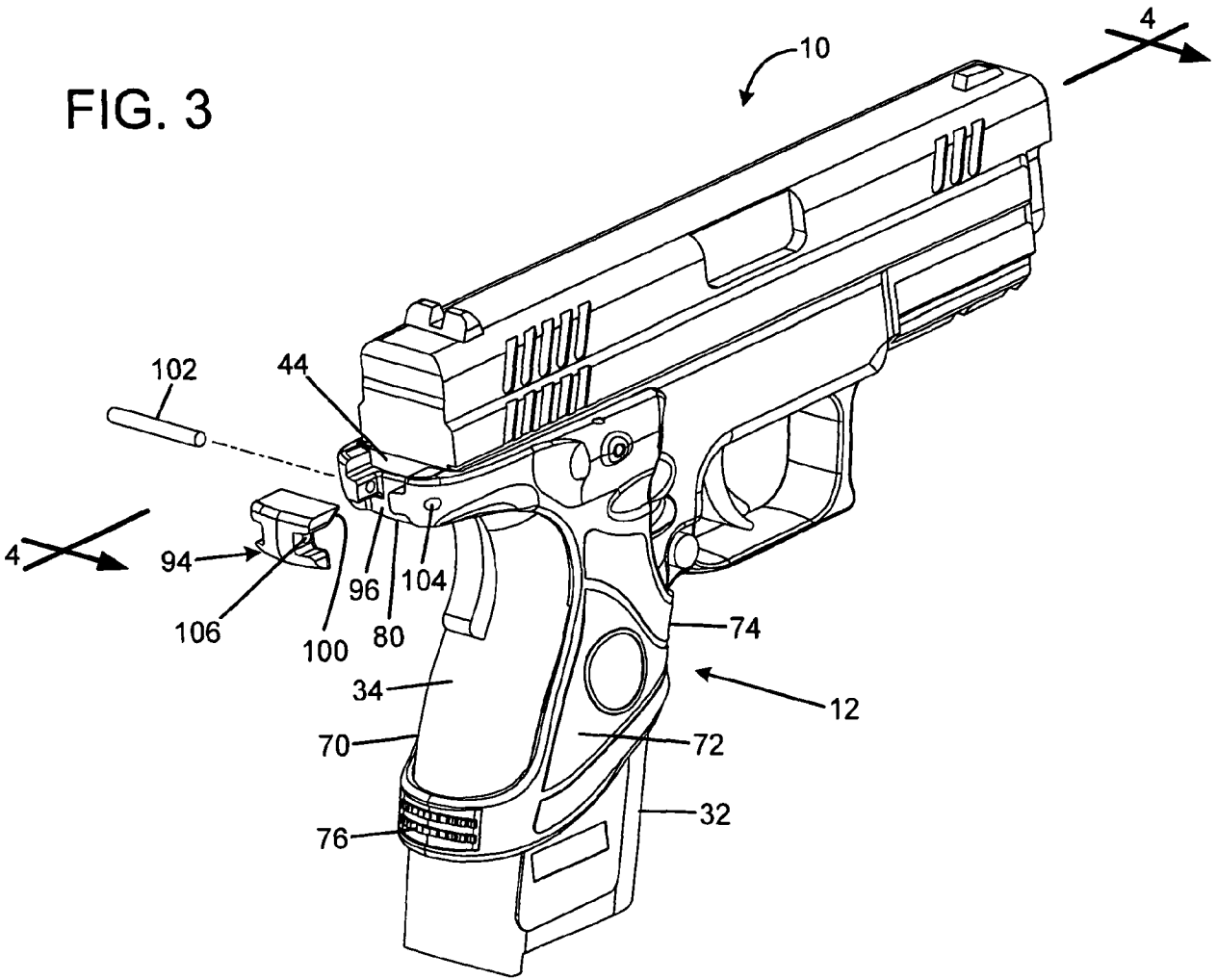
FIG. 3 is an exploded perspective view of the embodiment of FIG. 1 showing a locking piece removed.

FIG. 3 shows the device 12 installed on but not fully secured to the pistol 10. The upper surface 44 of the beavertail is exposed, and the rear span of the device has been slid upwards past the beavertail, because there are no portions to interfere with passage. To secure the device on the pistol, and to prevent unwanted removal or dislodgement, a rear lock piece 94 slides into a recess 96 in the rear of the device body at the upper rear span 80. The lock piece has an overhang ledge surface 100 that abuts the surface 44 when fully installed, and the overhang prevents removal. To secure the lock piece, a pin 102 is inserted in lateral bores 104 in the device body, and bore 106 in the lock piece. To prevent the lock piece from rotating on the pin, the lateral ends of the lock piece define fore-aft channels that closely mate with rails in the recess, for a tongue-and-groove or dovetail effect that secures the lock piece against rotation.

Figure 4:
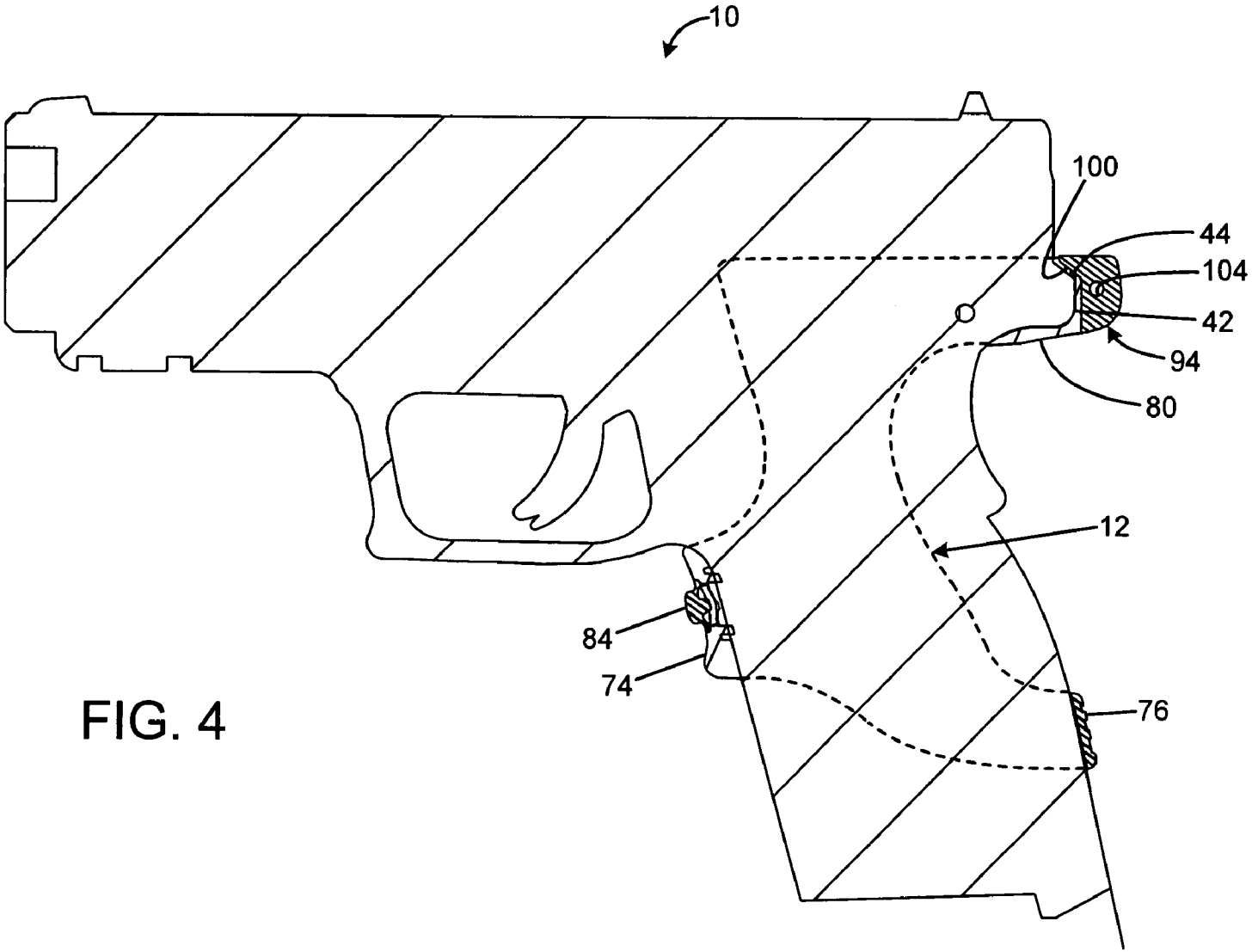
FIG. 4 is a medial sectional view of the preferred embodiment, taken along line 4-4 of FIG. 3.

FIG. 4 shows the engagement of the pistol's beavertail protrusion 42 and its upper surface 44 with the surface 100 of the locking piece 94. This also illustrates a "triangle of stability" provided by the three spans. Any elongated body may stably be located by gripping at two spaced-apart points on one side, and at an intermediate point on the other side. That is what the preferred embodiment does. The side panels and close fit prevent the device from shifting or rotating in most directions and axes. The three spans prevent rotation about a lateral axis (perpendicular to medial plane of the pistol.) The upper rear span and front span prevent rotation in a forward direction (CCW in FIG. 4), and the lower rear and front spans prevent rotation rearward.

In alternative embodiments, one of the three spans may be eliminated while still providing a secure mount. Positive location of the device with respect to the pistol is important, because any changes will result in misalignment of the laser beam from the point of impact of a projectile. Without the lower rear span, the device may still be stably held because the front strap is positively located vertically by the trigger guard, and the locking piece engagement of the beavertail prevents the rearward rotation normally prevented by the lower rear span.

The secure mounting is provided with no fasteners engaging the pistol. For installation and removal of the device, nothing on the pistol needs to be modified, adjusted, moved, removed, or reinstalled. This ensures that proper assembly and safety measures are not compromised, and that users will feel comfortable installing their own device, avoid the expense of professional installation.

Figure 5:
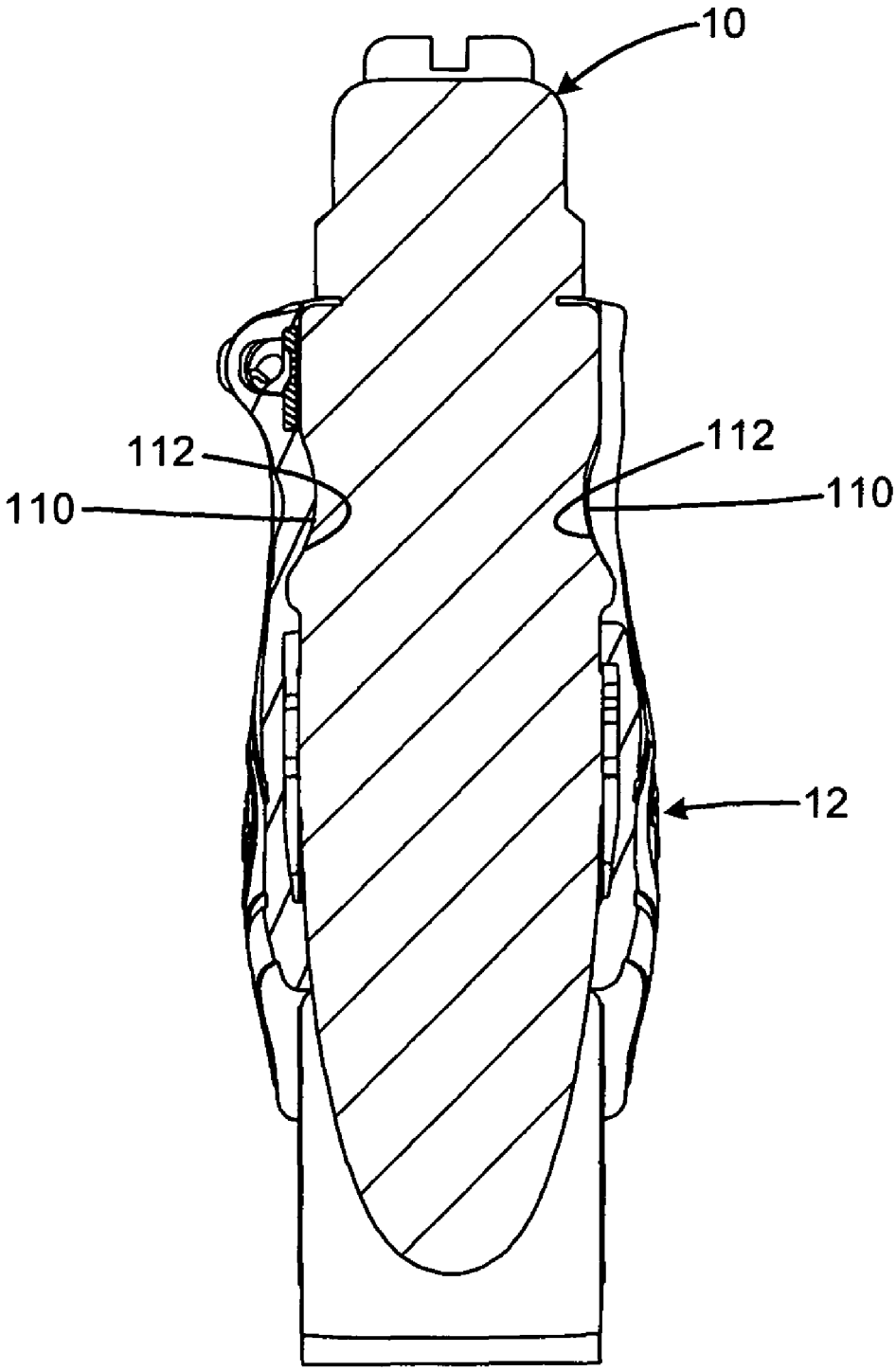
FIG. 5 is an axial sectional view of the preferred embodiment, taken along line 5-5 of FIG. 1.

As shown in FIG. 5, the device is kept secure on the frame by a close conformance of the interior of the body to the exterior of the handgrip. The frame is provided on its sides with oval recesses or "thumb scallops" 110 (also indicated in FIG. 1) that provide a comfortable place for left or right handed users to rest the thumb of the trigger hand. The device body interior has corresponding oval bumps 112 that conform to the shape of the recesses. The mating feature provides a detectable "detent" that helps the installer to confidently know when the device is fully installed. The principle of surface conformance may be employed on any portion or the entire interior of the device, with the shape set to conform to finger grooves found on the front straps of some pistols, or to be molded with a pattern that mates with the checkering, stippling, or any other texture provided on firearm grips.

In the preferred embodiment, in a full size pistol with a double stack magazine of common caliber (e.g. 9 mm, 40 S&W, 45ACP) the grip has a width of 1.0-1.25 inch. The grip length is typically about 4 inches in a full-size pistol, and about an inch less for a compact pistol. While these may vary among models and brands, they provide a context for the details of the preferred embodiment. With the device installed, about 2.0-2.5 inches of the upper back strap is exposed above the rear span, and the rear edges of the side panels are about 0.5 inch forward of the rear point of the back strap. This provides the comfortable feeling of a grip that is not perceived as significantly enlarged. The rear span 76 has a width of less than 0.5 inch, and a thickness of only about 0.062 inch. On the front strap, the front span has a width of about ⅞ inch, which is sized to reflect the width of an adult middle finger that will rest here as shown in FIG. 1.

The front span has a concave form that wraps about the front to provide a finger groove to naturally seat the illumination control finger over the switch. With its limited width, the next (ring) finger comfortably abuts the lower part of the front span, and grips the pistol's front strap, as does the little finger. This provides the sensation of a natural grip size, because only one (middle) finger is wrapping about an enlarged portion of the grip. Moreover, the side panels are contoured to be thick at their middles, and thin at their edges. This provides a desirably comfortable "palm swell" that does not significantly increase perceived circumference (adding a slight curve to a flat panel having minimal effect on the circumference.)

In alternative embodiments, one side panel may be omitted, and the device still secured by the front span, two (or even one) back spans, and one side panel joining them. Such a device would appear as a three-toed (or even two-toed) pen-annular "claw", and if sufficiently rigid, would provide adequate stability. Other embodiment may employ some elastomeric components that stretch to install over bulges, and provide adequate tension to retain the device in position.

While the above is discussed in terms of preferred and alternative embodiments, the invention is not intended to be so limited. For instance, while disclosed in the context of a pistol, the device may similarly be applied to a rifle having a protruding handgrip, or to a firearm handgrip in a forward location such as mounted in front of the magazine of a military rifle for gripping with the non-trigger hand.

The invention claimed is:

1. A sighting device for a firearm having a handgrip having a front strap, a back strap, and a free end, the sighting device comprising:

a body including a sleeve defining a bore sized to closely encircle at least a portion of the handgrip;

the sleeve having a front portion configured to wrap about at least a forward front strap portion of the handgrip;

the sleeve having a rear portion configured to wrap about at least a rear back strap portion of the handgrip;

a laser device connected to the body; and wherein the device is free of any fasteners engaging the firearm.

2. The sighting device of claim 1 wherein the laser device is rigidly connected to the sleeve.

3. The sighting device of claim 2 wherein the laser device is enclosed in a laser housing that is integral with the sleeve.

4. The sighting device of claim 1 wherein the front portion and the rear portion are integrally formed with each other.

5. The sighting device of claim 1 wherein the body is formed of a rigid thermoplastic.

6. The sighting device of claim 1 wherein the front portion of the sleeve includes an activation switch operably connected to the laser.

7. The sighting device of claim 6 wherein the firearm defines a medial plane and the activation switch is positioned on the medial plane.

8. The sighting device of claim 1 wherein the front portion of the sleeve is configured to be positioned immediately below a trigger guard of the firearm when installed on the firearm, such that a user's middle finger of the trigger hand naturally rests on the forward portion when gripping the firearm.

9. The sighting device of claim 1 wherein the front portion of the sleeve has a limited width extending along the length of the handgrip, and the limited width corresponds to the width of an adult finger, such that a third ring finger rests directly on a forward portion of the handgrip immediately below the forward portion of the sleeve.

10. The sighting device of claim 1 wherein the rear portion of the sleeve is positioned at a level below the front portion when installed on the firearm.

11. The sighting device of claim 1 wherein the rear portion of the sleeve has a limited width, substantially less than the length of the back strap, such that a majority of the back strap is exposed when the device is installed on the firearm.

12. The sighting device of claim 1 wherein the rear portion of the sleeve is configured to be positioned below a midpoint of the length of the back strap, such that an upper portion of the back strap is exposed when the device is installed on the firearm.

13. The sighting device of claim 1 wherein the firearm has a protrusion, and wherein the sighting device includes a lock element configured to the protrusion, such that the sleeve is retained against removal from the handgrip by the lock element engaging the protrusion.

14. The sighting device of claim 13 wherein the lock element is removably secured to the body.

15. The sighting device of claim 13 wherein the lock element defines a lock bore, and the body defines a body bore, and the bores are aligned and occupied by a pin to secure the lock element to the body.

16. The sighting device of claim 13 wherein the lock element has an upper portion located immediately above a portion of the protrusion when the lock element is installed, such that the upper portion engages the protrusion to prevent the sleeve from being removed from the grip.

17. The sighting device of claim 1 wherein the sleeve defines an interior surface that closely conforms to the surface of the grip.

18. The sighting device of claim 1 wherein the sleeve includes opposed side panels, the side panels being joined at front portions by a front span, at lower rear position by a lower rear span, and at upper rear portion by an upper rear span.

19. A sighting device for a firearm having a handgrip having a front strap, a back strap, and a free end, the sighting device comprising:

a body having a front portion configured to wrap about at least a forward front strap portion of the firearm;

the body having a rear first portion configured to wrap about at least a rear backstrap portion of the firearm;

a laser device connected to the body; and wherein the device is free of any fasteners engaging the firearm.

20. The sighting device of claim 19 including a second rear portion spaced apart from the first rear portion and configured to wrap about a rear portion of the firearm.

21. A sighting device for a firearm having a handgrip having a front strap, a back strap, and a free end, the sighting device comprising:

a body including a sleeve defining a bore sized to closely encircle at least a portion of the handgrip;

the sleeve having a front portion configured to wrap about at least a forward front strap portion of the handgrip;

the sleeve having a rear portion configured to wrap about at least a rear back strap portion of the handgrip;

a laser device connected to the body;

wherein the firearm has a protrusion, and wherein the sighting device includes a lock element configured to the protrusion, such that the sleeve is retained against removal from the handgrip by the lock element engaging the protrusion; and wherein the lock element has an upper portion located immediately above a portion of the protrusion when the lock element is installed, such that the upper portion engages the protrusion to prevent the sleeve from being removed from the grip.

* * * * *